US011608983B2

(12) United States Patent
Hunniford et al.

(10) Patent No.: US 11,608,983 B2
(45) Date of Patent: Mar. 21, 2023

(54) GAS BURNER SYSTEMS AND METHODS FOR CALIBRATING GAS BURNER SYSTEMS

(71) Applicant: Brunswick Corporation, Mettawa, IL (US)

(72) Inventors: Thomas James Colin Hunniford, Newtownards (GB); Stuart C. Black, Ballclare (GB); Philip Eadie, Donaghadee (GB)

(73) Assignee: Brunswick Corporation, Mettawa, IL (US)

( * ) Notice: Subject to any disclaimer, the term of this patent is extended or adjusted under 35 U.S.C. 154(b) by 294 days.

(21) Appl. No.: 17/109,339

(22) Filed: Dec. 2, 2020

(65) Prior Publication Data

US 2022/0170635 A1 Jun. 2, 2022

(51) Int. Cl.
*F23N 3/00* (2006.01)
*F23N 5/18* (2006.01)

(52) U.S. Cl.
CPC ..... *F23N 3/005* (2013.01); *F23N 5/187* (2013.01); *F23N 2005/181* (2013.01);
(Continued)

(58) Field of Classification Search
CPC . F23N 3/005; F23N 5/187; F23N 5/12; F23N 5/123; F23N 5/126; F23N 2227/20;
(Continued)

(56) References Cited

U.S. PATENT DOCUMENTS 3,671,150 A 6/1972 Jackson et al.
4,086,048 A 4/1978 Carlson
(Continued)

FOREIGN PATENT DOCUMENTS

CA 2188616 C * 1/2001 ..... F23N 1/022
DE 3144787 8/1983
(Continued)

OTHER PUBLICATIONS

European Search Report, EP Patent Application No. 21204492.9, dated Apr. 13, 2022.
(Continued)

*Primary Examiner* — Steven B McAllister
*Assistant Examiner* — Daniel E. Namay
(74) *Attorney, Agent, or Firm* — Andrus Intellectual Property Law, LLP

(57) ABSTRACT

A gas burner system and corresponding methods include a gas burner through which an air-gas mixture is conducted; a variable-speed forced-air device that forces air through the gas burner; a control valve that controls a supply of gas for mixture with the air to thereby form the air-gas mixture; an electrode configured to ignite the air-gas mixture and produce a flame, wherein the electrode is further configured to measure an actual flame strength of the flame; a controller; and an input device for inputting a calibration command to the controller. Upon receipt of the calibration command, the controller is configured to automatically calibrate and save the target flame strength set point and thereafter automatically regulate a speed of the variable-speed forced-air device to cause the actual flame strength to achieve the target flame strength set point.

18 Claims, 10 Drawing Sheets

(52) U.S. Cl.
CPC ..... *F23N 2227/20* (2020.01); *F23N 2227/36* (2020.01); *F23N 2229/00* (2020.01); *F23N 2237/10* (2020.01)

(58) Field of Classification Search
CPC ..... F23N 2227/36; F23N 2237/10; F23N 2239/00; F23N 2239/12; F23N 2005/181
USPC ..... 431/12, 75, 6
See application file for complete search history.

(56) References Cited

U.S. PATENT DOCUMENTS

| | | | | |
|---|---|---|---|---|
| 4,244,349 | A | 1/1981 | Velie et al. | |
| 4,474,534 | A | 10/1984 | Thode | |
| 4,477,245 | A * | 10/1984 | Giachino | F23N 5/082 431/12 |
| 4,712,996 | A | 12/1987 | Adams et al. | |
| 5,062,790 | A | 11/1991 | Loberger et al. | |
| 5,232,153 | A | 8/1993 | Mohring et al. | |
| 5,335,841 | A | 8/1994 | Yamanashi | |
| 5,355,841 | A | 10/1994 | Moore, Jr. et al. | |
| 5,682,826 | A | 11/1997 | Hollenbeck | |
| 5,865,616 | A | 2/1999 | George | |
| 5,924,859 | A | 7/1999 | Nolte | |
| 5,931,660 | A | 8/1999 | Amrhein et al. | |
| 5,984,664 | A | 11/1999 | Sutton | |
| 7,131,462 | B1 | 11/2006 | Chen | |
| 7,223,094 | B2 | 5/2007 | Goebel | |
| 8,075,304 | B2 | 12/2011 | Cox et al. | |
| 9,046,108 | B2 | 6/2015 | Duke et al. | |
| 10,718,518 | B2 * | 7/2020 | Eadie | F23D 14/36 |
| 2002/0086254 | A1 | 7/2002 | Chen | |
| 2004/0038167 | A1 | 2/2004 | Han | |
| 2006/0051718 | A1 | 3/2006 | Kamal et al. | |
| 2006/0199123 | A1 | 9/2006 | Seguin et al. | |
| 2008/0266120 | A1 * | 10/2008 | Leeland | F23N 5/242 340/578 |
| 2009/0211540 | A1 | 8/2009 | Yin et al. | |
| 2010/0112500 | A1 | 5/2010 | Maiello et al. | |
| 2011/0052385 | A1 | 3/2011 | Duke | |
| 2014/0209086 | A1 | 7/2014 | Potter | |
| 2015/0081086 | A1 | 3/2015 | Hallowell et al. | |
| 2015/0276221 | A1 | 10/2015 | Abate et al. | |
| 2016/0047547 | A1 | 2/2016 | Barels | |
| 2016/0138799 | A1 * | 5/2016 | Colannino | F23N 5/12 431/2 |
| 2016/0281984 | A1 * | 9/2016 | Munsterhuis | F23N 1/022 |
| 2016/0363316 | A1 | 12/2016 | Park et al. | |
| 2017/0030581 | A1 | 2/2017 | Li et al. | |
| 2019/0162408 | A1 * | 5/2019 | Eadie | F23N 5/24 |
| 2020/0025368 | A1 | 1/2020 | Black et al. | |
| 2020/0232643 | A1 | 7/2020 | Henrich | |

FOREIGN PATENT DOCUMENTS

| | | | | |
|---|---|---|---|---|
| DE | 3604314 | | 8/1987 | |
| DE | 10300602 | A1 * | 7/2003 | F23N 1/022 |
| DE | 10220774 | | 11/2003 | |
| DE | 102020008001 | A1 * | 10/2021 | F23N 5/12 |
| EP | 0770824 | A2 * | 1/1996 | F23N 5/123 |
| EP | 1207340 | A2 * | 5/2002 | F23D 14/60 |
| EP | 1650502 | A2 * | 4/2006 | F23N 1/002 |
| EP | 2278224 | | 1/2011 | |
| EP | 2667097 | | 11/2013 | |
| EP | 2871415 | | 5/2015 | |
| EP | 3124866 | | 2/2017 | |
| EP | 3156729 | A2 * | 4/2017 | F23N 1/002 |
| JP | 59131826 | A * | 1/1983 | F23N 5/12 |
| WO | 2010094673 | | 8/2010 | |
| WO | 2017085680 | | 5/2017 | |

OTHER PUBLICATIONS

Donald Ewald et al., Noise Reduction by Applying Modulation Principles, The University of Wisconsin, Department of Mechanical Engineering, Madison, Wisconin 53705, The Journal of the Acoustical Society of America, Received Nov. 23, 1970, pp. 1381-1385.
Extended European Search Report for European Patent Application No. 19181303.9, dated Feb. 20, 2020.
Extended European Search Report, EP Patent Application No. 18208791, dated Jul. 18, 2019.
Office Action issued for European Patent Application No. 19181303.9, dated Nov. 21, 2019.
Partial European Search Report, EP Patent Application No. 18208791, dated Mar. 28, 2019.
Partial European Search Report, EP Patent Application No. 20189202.3, dated Sep. 18, 2020.
Extended European Search Report, EP Patent Application No. 20189202.3, dated Nov. 13, 2020.
Extended European Search Report, EP Patent Application No. 21162729.4, dated Jun. 25, 2021.

* cited by examiner

| POWER SETTING | OUTLET 1 | OUTLET 2 |
|---|---|---|
| OFF | CLOSED | CLOSED |
| LOW | OPEN | CLOSED |
| MEDIUM | CLOSED | OPEN |
| HIGH | OPEN | OPEN |

* USUALLY INCREASE CAF BUT IF TARGET SET POINT IS ABOVE FLAME STRENGTH THE DECREASE CAF

GAS BURNER SYSTEMS AND METHODS FOR CALIBRATING GAS BURNER SYSTEMS

FIELD

The present disclosure relates to gas burners, for example gas burners that fully pre-mix liquid propane gas and air for combustion. The present disclosure further relates to systems and methods for operating such fully pre-mix gas burners.

BACKGROUND

The following patent and publications are incorporated herein by reference.

International Publication No. WO2010/094673 discloses a premix gas burner having a burner surface which exhibits a plurality of flow passages and at least two ionization electrodes connected to a measuring device and preferably also to a control device. The ionization electrodes are arranged at different distances from the burner surface and the ionization electrodes are arranged electronically in parallel and electric currents are measured over each ionization electrode and the burner surface, the burner thus serving as earth in the electrical circuit. The measured currents provide a more accurate verification of the occurrence of combustion and show proof of the combustion quality.

U.S. Pat. No. 10,718,518 discloses a gas burner system having a gas burner with a conduit through which an air-gas mixture is conducted; a variable-speed forced-air device that forces air through the conduit; a control valve that controls a supply of gas for mixture with the air to thereby form the air-gas mixture; and an electrode configured to ignite the air-gas mixture to produce a flame. The electrode is further configured to measure a flame ionization current associated with the flame. A controller is configured to actively control the variable-speed forced-air device based on the flame ionization current measured by the electrode to automatically avoid a flame harmonic mode of the gas burner. Corresponding methods are provided.

U.S. Patent Publication No. 2020/025368 discloses a forced-draft pre-mix burner device having a housing that conveys air from an upstream cool air inlet to a downstream warm air outlet. A heat exchanger warms the air prior to discharge via the warm air outlet. A gas burner burns an air-gas mixture to thereby warm the heat exchanger. A fan mixes the air-gas mixture and forces the air-gas mixture into the gas burner. The fan has a plurality of blades having sinusoidal-modulated blade spacing.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

A gas burner system has a gas burner through which an air-gas mixture is conducted; a variable-speed forced-air device that forces air through the gas burner; a control valve that controls a supply of gas for mixture with the air to thereby form the air-gas mixture; an electrode configured to ignite the air-gas mixture and produce a flame, wherein the electrode is further configured to measure an actual flame strength of the flame; a controller; and an input device for inputting a calibration command to the controller. Upon receipt of the calibration command, the controller is configured to automatically calibrate and save a target flame strength set point and thereafter automatically regulate a speed of the variable-speed forced-air device to cause the actual flame strength to achieve the target flame strength set point.

A method is for operating a gas burner. The method comprises providing a gas burner; supplying a gas to the gas burner; operating a variable-speed forced-air device to force air into the gas burner and mix with the gas to form an air-gas mixture; operating an electrode to ignite the air-gas mixture and produce a flame; and operating a controller to automatically calibrate and save a target flame strength set point for the controller, and to thereafter monitor an actual flame strength via the electrode and regulate a speed of the variable-speed forced air device to achieve the target flame strength set point.

DETAILED DESCRIPTION OF THE DRAWINGS

It is desirable to manufacture heat exchangers that operate safely and efficiently. During research and development, the present inventors have determined it is often challenging to attain these goals, especially in view of variations that inherently occur amongst various manufactured components and amongst various manufacturing settings. As such, the inventors determined it would be advantageous to provide improved gas burner systems and related methods that are configured to automatically compensate for these factors. The inventors further determined it would be advantageous to configure such gas burner systems and methods in a way that minimizes the requisite number of parts and steps, for example requiring only a single electrode for monitoring flame strength and for safely and efficiently controlling to a target set point that is specially calibrated for the particular system.

Figure 1:
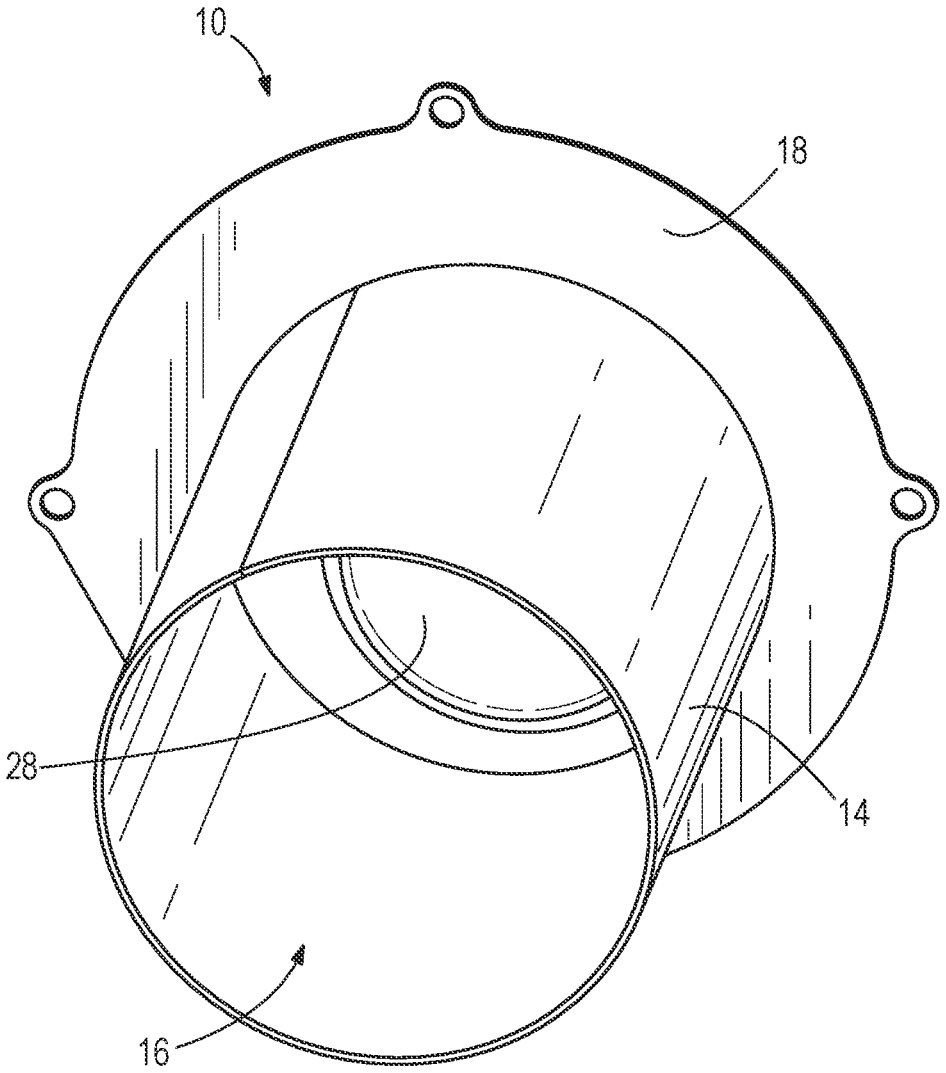
FIG. 1 is a perspective view of an exemplary gas burner.
Figure 2:
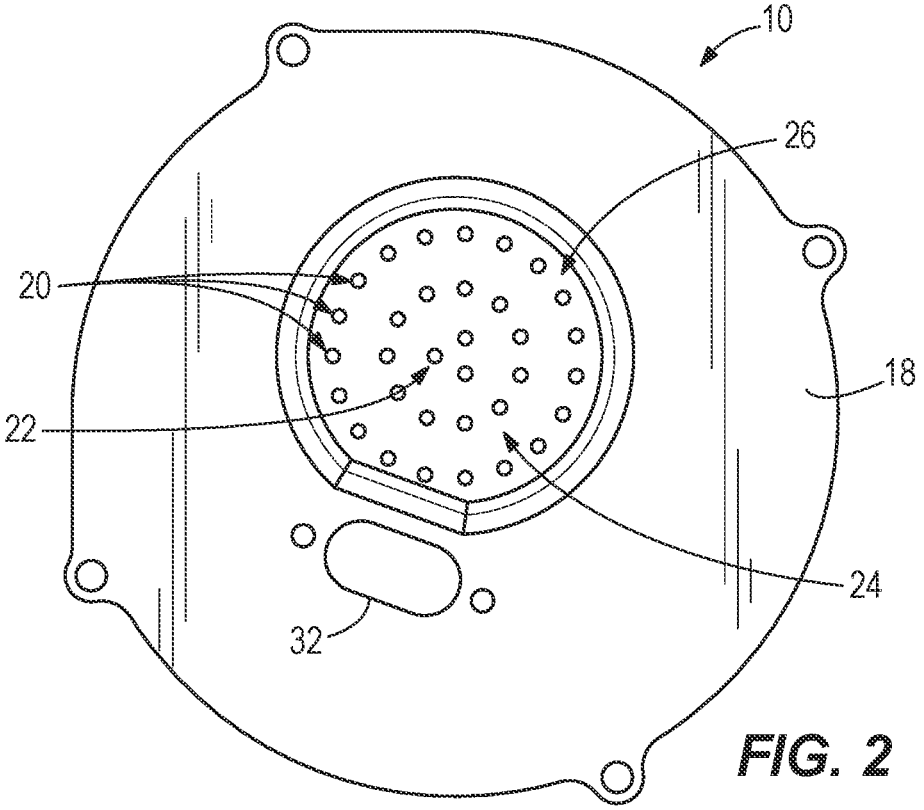
FIG. 2 is an end view of the gas burner.
Figure 3:
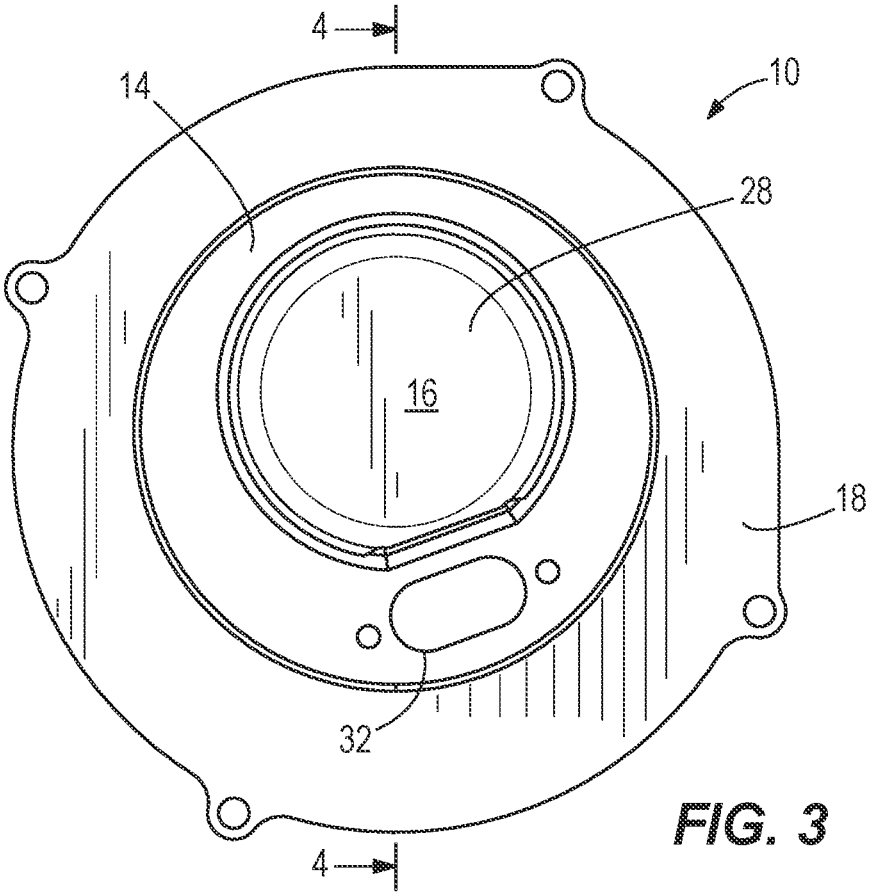
FIG. 3 is an opposite end view of the gas burner.

FIGS. 1-4 depict an exemplary gas burner 10. The gas burner 10 has an elongated metal flame tube 14 that defines a conduit 16 into which a fully pre-mixed air-gas mixture is conveyed for combustion. A metal burner deck 18 is disposed on one end of the flame tube 14. The burner deck 18 has a plurality of aeration holes 20 through which the air-gas mixture is caused to flow, as will be further explained herein below. In the non-limiting illustrated example, the plurality of aeration holes 20 includes a total of thirty-three aeration holes, each hole having a diameter of between 1.9 and 2.1 millimeters. A first group of three holes 22 are in the center of the plurality and are spaced apart equidistant from each other and surrounded by a second group of eleven holes 24 that are spaced equidistant from each other. The second group of eleven holes 24 is surrounded by a third group of nineteen holes 26 that are also spaced equidistant from each other. As shown in FIG. 2, the second and third groups of holes 24, 26 form two concentric circles around the first group of three holes 22. Together, the plurality of aeration holes 20 provides an open area of between 18.7%-22.8% of the portion of the burner deck 18 inside the conduit 16.

Figure 4:
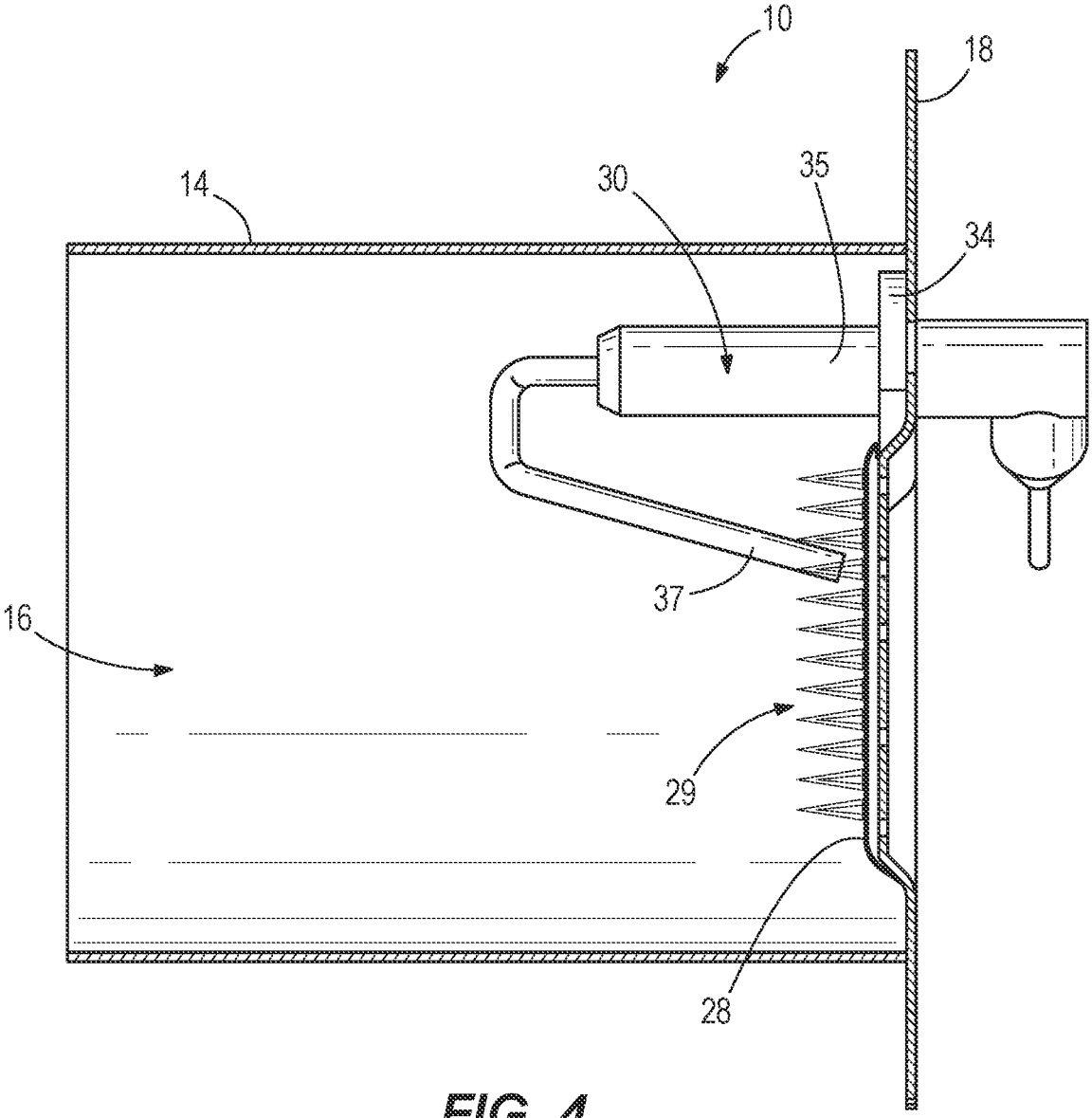
FIG. 4 is a sectional view of the gas burner, showing a flame and an electrode inside the gas burner.

A metal burner skin 28 located inside the flame tube 14 is attached to the inside surface of the burner deck 18 so that the burner skin 28 covers the plurality of aeration holes 20. The burner skin 28 is made of woven metal matting, however the type and configuration of burner skin 28 can vary from what is shown. As shown in FIG. 4, the burner skin 28 is configured to distribute the air-gas mixture from the plurality of aeration holes 20 and thus facilitate a consistent and evenly distributed burner flame 29 inside the flame tube 14.

An ignition and flame sensing electrode 30 is located in the flame tube 14, proximate to the burner skin 28. The electrode 30 extends through a through-bore 32 in the burner deck 18 and is fastened to the burner deck 18 via a connecting flange 34. The type of electrode 30 and the way the electrode 30 is coupled to the gas burner 10 can vary from what is shown. The electrode 30 can be a conventional item, for example a Rauschert Electrode, Part No. P-17-0044-05. The electrode 30 has a ceramic body 35 and an electrode tip 37 that is oriented towards the burner skin 28. The electrode 30 is configured to ignite the air-gas mixture in a conventional manner, as the air-gas mixture passes through the conduit 16 via the plurality of aeration holes 20. The resulting burner flame 29 is thereafter maintained as the air-gas mixture flows through the burner skin 28.

The electrode 30 is further configured to measure the flame ionization current associated with the burner flame 29. The electrode tip 37 is placed at the location of the burner flame 29 with 2.5+/−0.5 mm between the electrode tip 37 and the burner skin 28. A voltage of 275+/−15V is applied across the electrode 30 and burner skin 28, with the electrode 30 alternating positive and negative and the burner skin being neutral. Chemical reactions that occur during combustion create charged particles, which are proportional to the air/fuel ratio of a given fuel. The potential difference across the gas burner 10 can be used to measure and quantify this. The electrode 30 is configured to measure the differential and, based on the differential, determine the flame ionization current, as is conventional and known in the art. The flame ionization current is inversely proportional to actual fuel-to-air equivalence ratio for a given mixture.

Figure 5:
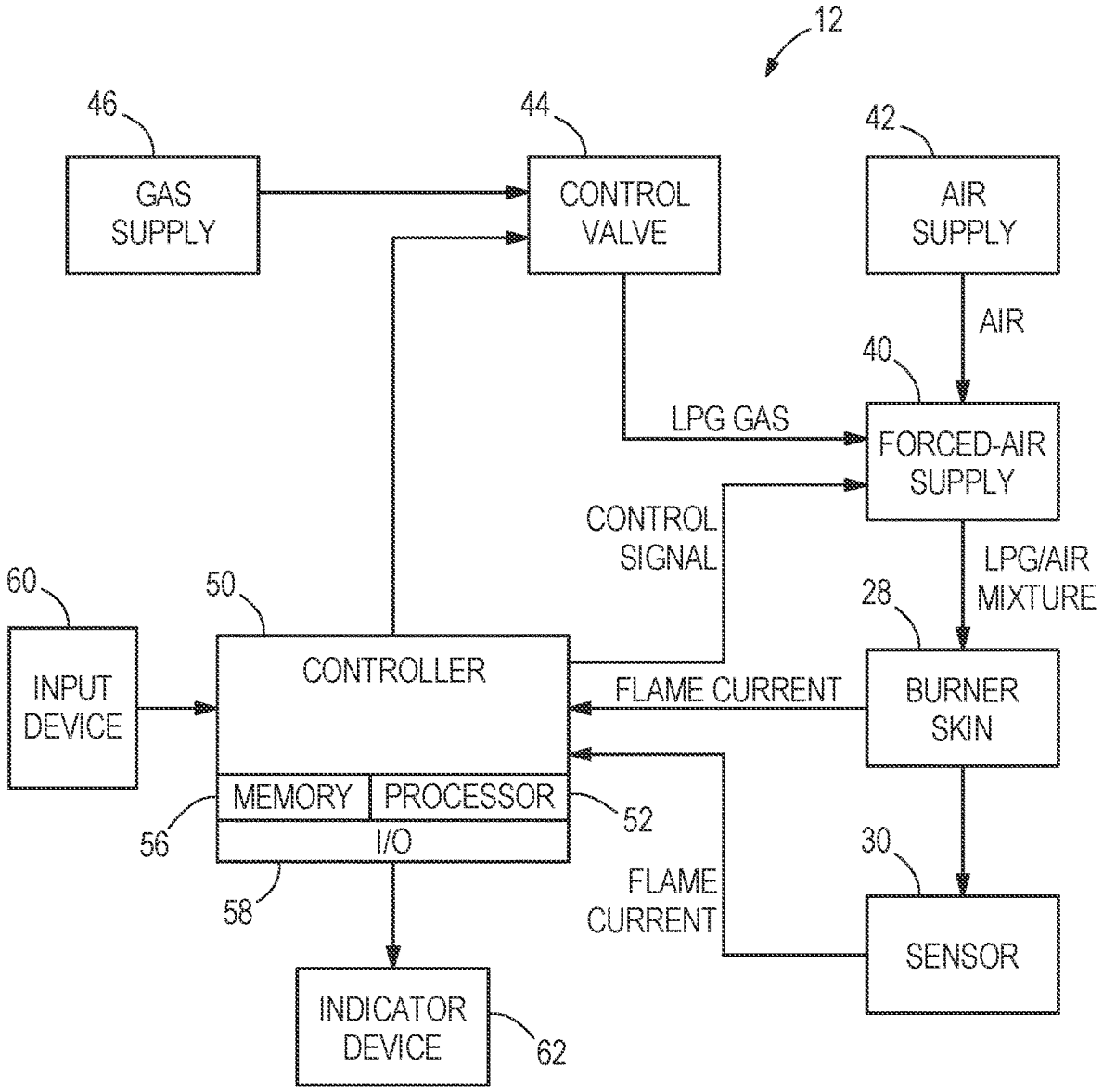
FIG. 5 is a schematic view of a gas burner system incorporating the gas burner.

Referring now to FIG. 5, the gas burner 10 is part of a gas burner system 12. The gas burner system 12 includes a variable-speed forced-air device 40, which for example can be a fan and/or a blower having a speed that can be varied. One example is a fan powered by a brushless DC motor. The gas burner system 12 also includes a supply of a gas 46 that is combustible, such as liquid propane gas, and a control valve 44 configured to control the supply of gas 46 to the gas burner 10. As further described herein below with reference to FIGS. 6 and 7, the control valve 44 is a solenoid that is movable into a fully closed position preventing flow of gas and alternately into one of several open positions allowing flow of gas. In use, the variable-speed forced-air device 40 is configured to force a mixture of air from the supply of ambient air 42 and combustible gas from the supply of gas 46 through the plurality of aeration holes 20 and into the conduit 16. It will thus be understood by those having ordinary skill in the art that the gas burner system 12 is a "fully premix" gas burner system in which all the gas (e.g., LPG) is introduced via the control valve 44 and all air introduced into the conduit 16 is introduced via the variable-speed forced-air device 40. The air and gas are mixed to form the above-mentioned air-gas mixture, which is ignited by the electrode 30 in the conduit 16.

The gas burner system 12 also includes a computer controller 50. As explained herein below, the controller 50 is configured (e.g., programmed and communicatively connected) to actively control the speed of the forced-air device 40 based on the flame ionization current measured by the electrode 30, which correlates to a flame strength in the gas burner 10. An increase in flame ionization current corresponds to an increase in flame strength, and vice versa.

The controller 50 includes a computer processor 52, computer software, a memory 56 (i.e. computer storage), and one or more conventional computer input/output (interface) devices 58. The processor 52 loads and executes the software from the memory 56. Executing the software controls operation of the system 12 according to the method steps shown in FIG. 11 and further described herein below. The processor 52 can include a microprocessor and/or other circuitry that receives and executes software from memory 56. The processor 52 can be implemented within a single device, but it can alternately be distributed across multiple processing devices and/or subsystems that cooperate in executing program instructions. Examples include general purpose central processing units, application specific processors, and logic devices, as well as any other processing device, combinations of processing devices, and/or variations thereof. The controller 50 can be located anywhere with respect to the gas burner 10 and can communicate with various components of the gas burner system 12 via the wired and/or wireless links shown schematically in the drawings.

The memory 56 can include any storage media that is readable by the processor 52 and capable of storing the software. The memory 56 can include volatile and/or non-volatile, removable, and/or non-removable media implemented in any method or technology for storage of information, such as computer readable instructions, data structures, program modules, or other data. The memory 56 can be implemented as a single storage device but may also be implemented across multiple storage devices or subsystems.

The computer input/output device 58 can include any one of a variety of conventional computer input/output interfaces for receiving electrical signals for input to the processor 52 and for sending electrical signals from the processor 52 to various components of the gas burner system 12. The controller 50, via the noted input/output device 58, communicates with the electrode 30, forced-air device 40 and control valve 44 to automatically control operation of the gas burner system 12. The controller 50 is capable of monitoring and controlling operational characteristics of the gas burner system 12 by sending and/or receiving control signals via one or more of the links. Although the links are each shown as a single link, the term "link" can encompass one or a plurality of links that are each connected to one or more of the components of the gas burner system 12. As mentioned herein above, these can be wired or wireless links.

The gas burner system 12 further includes one or more operator input devices 60 for inputting operator commands to the controller 50. The operator input device 60 can include a power setting selector, which can include for example a push button, switch, touch screen, or other device for inputting an instruction signal to the controller 50 from the operator of the of system 12. Such operator input devices for inputting operator commands to a controller are well known in the art and therefore for brevity are not further herein described. The operator input device 60 can also include a keyboard or any other conventional mechanism for inputting a command to the controller 50, which for example includes selection of a power setting and/or request for a calibration method to be carried out by the controller 50, as will be further described herein below.

The gas burner system 12 further includes one or more indicator devices 62, which can include a visual display screen, a light, an audio speaker, or any other device for providing feedback to the operator of the system. The indicator device(s) 62 can be located on the gas burner system 12 or remotely therefrom.

Figure 7:
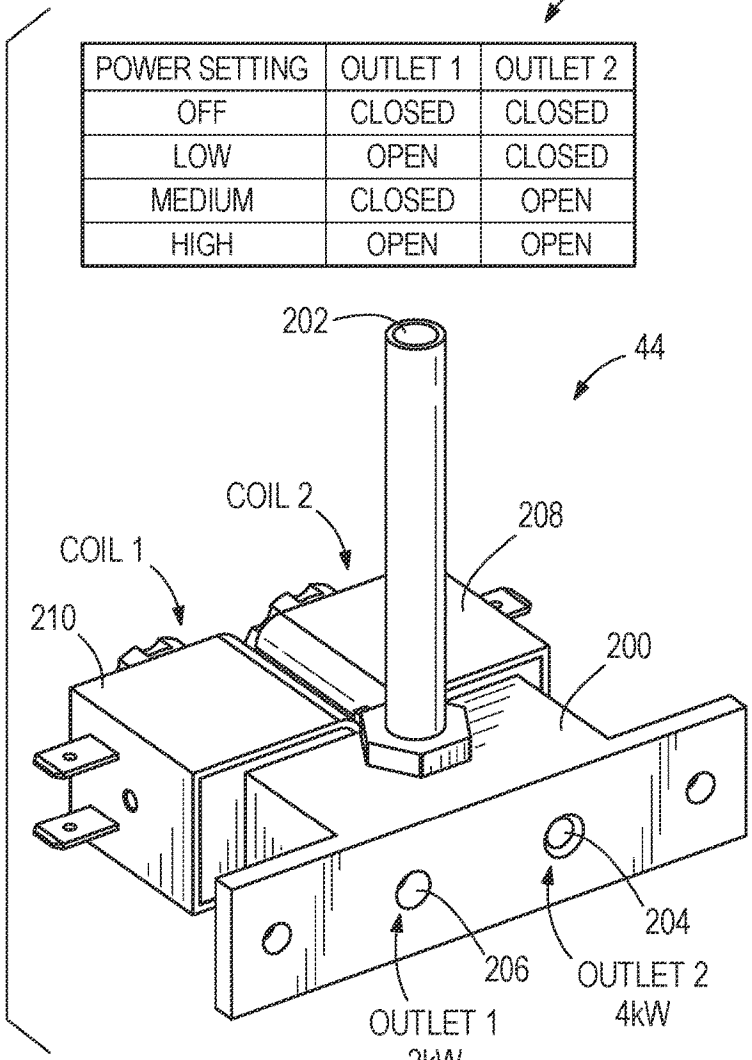
FIGS. 6 and 7 depict one example of a control valve for controlling a supply of gas to the gas burner.
Figure 6:
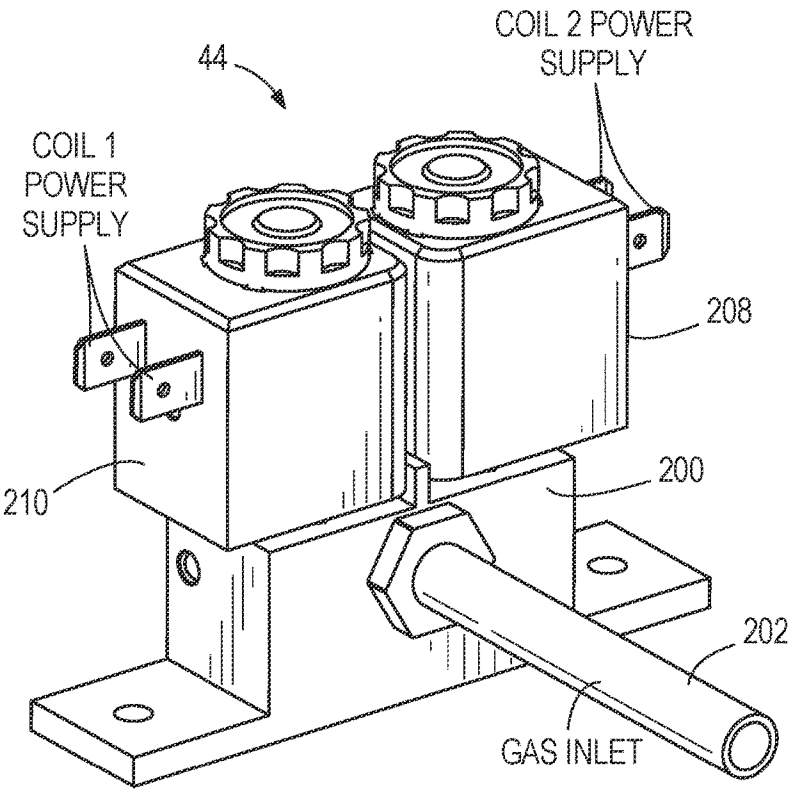

The supply of gas 46 is controlled by the control valve 44 according to discrete settings for heat input (i.e., "power settings"). An example of a suitable control valve 44 is shown in FIGS. 6 and 7. In this example, the control valve 44 has a valve body 200 with an inlet port 202 that receives a combustible gas from the supply of gas 46 and a pair of outlet ports 204, 206 which, in parallel, discharge the gas for combustion in the gas burner 10. A pair of conventional solenoid coils 208, 210 are connected to the valve body 200 and configured to independently control discharge of the gas via the pair of outlet ports 204, 206, respectively. Each solenoid coil 208, 210 is connected to a respective one of the outlet ports 204, 206 and configured to fully open and fully close to thereby control the flow of gas therethrough. Each of the solenoid coils 208, 210 is electrically coupled to a power supply, as shown, and configured such that the controller 50 can selectively cause the solenoid coils 208, 210 to independently open and/or shut. The exemplary control valve 44 facilitates four discrete power settings, see Table 213 in FIG. 7. The power settings include "off" wherein both of the solenoid coils 208, 210 are fully closed, "low" wherein the solenoid coil 208 is fully open and the solenoid coil 210 is fully closed, "medium" wherein the solenoid coil 208 is fully closed and the solenoid coil 210 is fully open, and "high" wherein both of the solenoid coils 208, 210 are fully open.

In a non-limiting example, the forced-air device 40 is a fan and the following discrete power settings are available, corresponding to the above-noted settings of the control valve 44. Each power setting has a minimum fan speed saved in the memory 56 of the controller 50.

| Power Setting | Gross Heat Input (kW) | Min Fan Speed (rpm) |
|---|---|---|
| Off | 0 | 0 |
| Low | 1.35 | 1500 |
| Medium | 4.7 | 3600 |
| High | 6 | 4800 |

Figure 8:
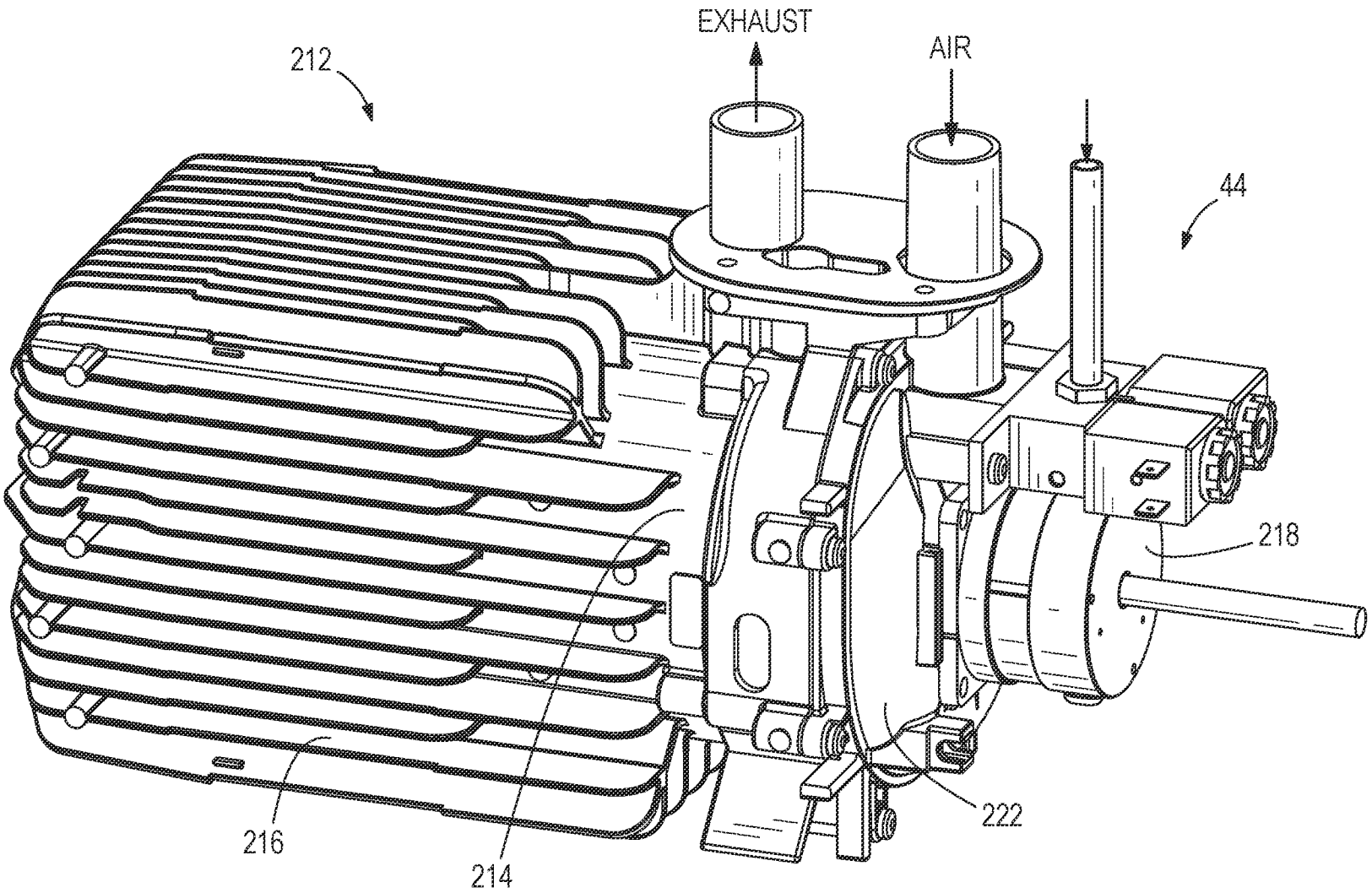
FIG. 8 is a perspective view of portions of an exemplary gas burner system having a heat exchanger.
Figure 9:
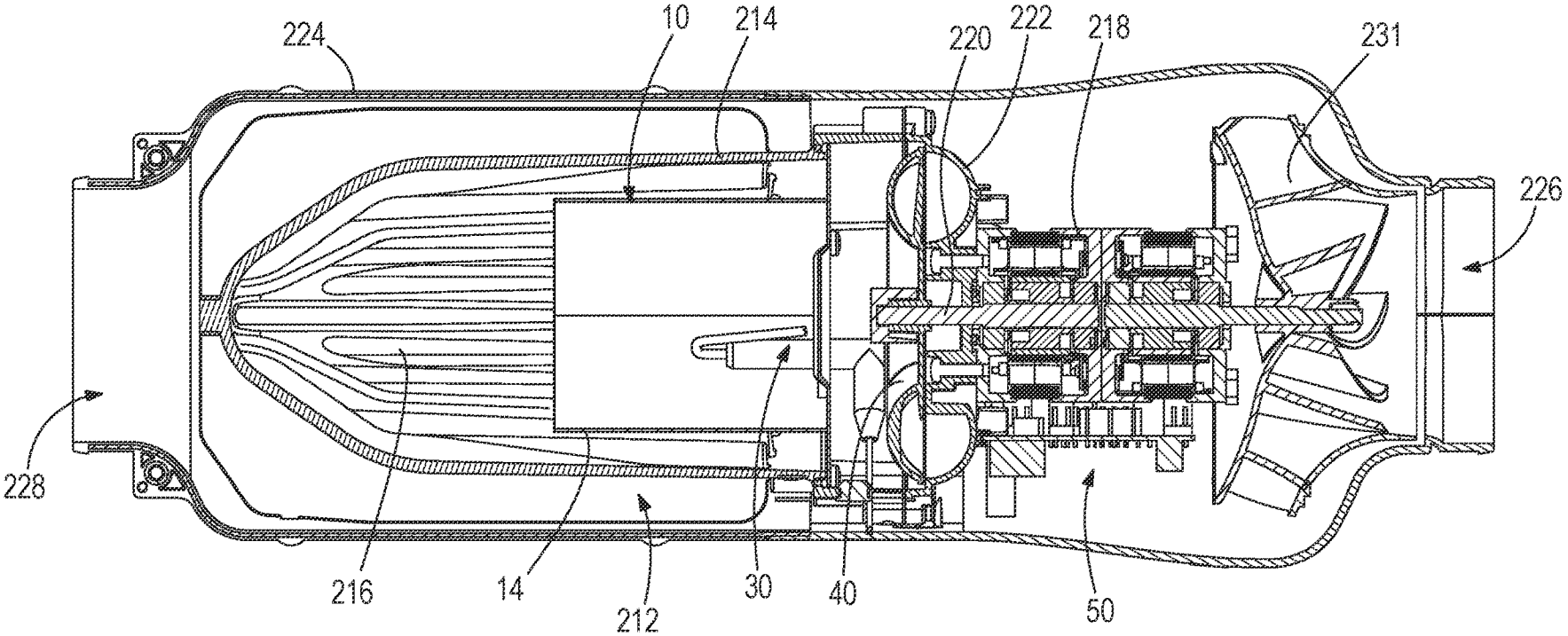
FIG. 9 is a sectional view of the example shown in FIG. 8 including a housing surrounding the heat exchanger and fan.
Figure 10:
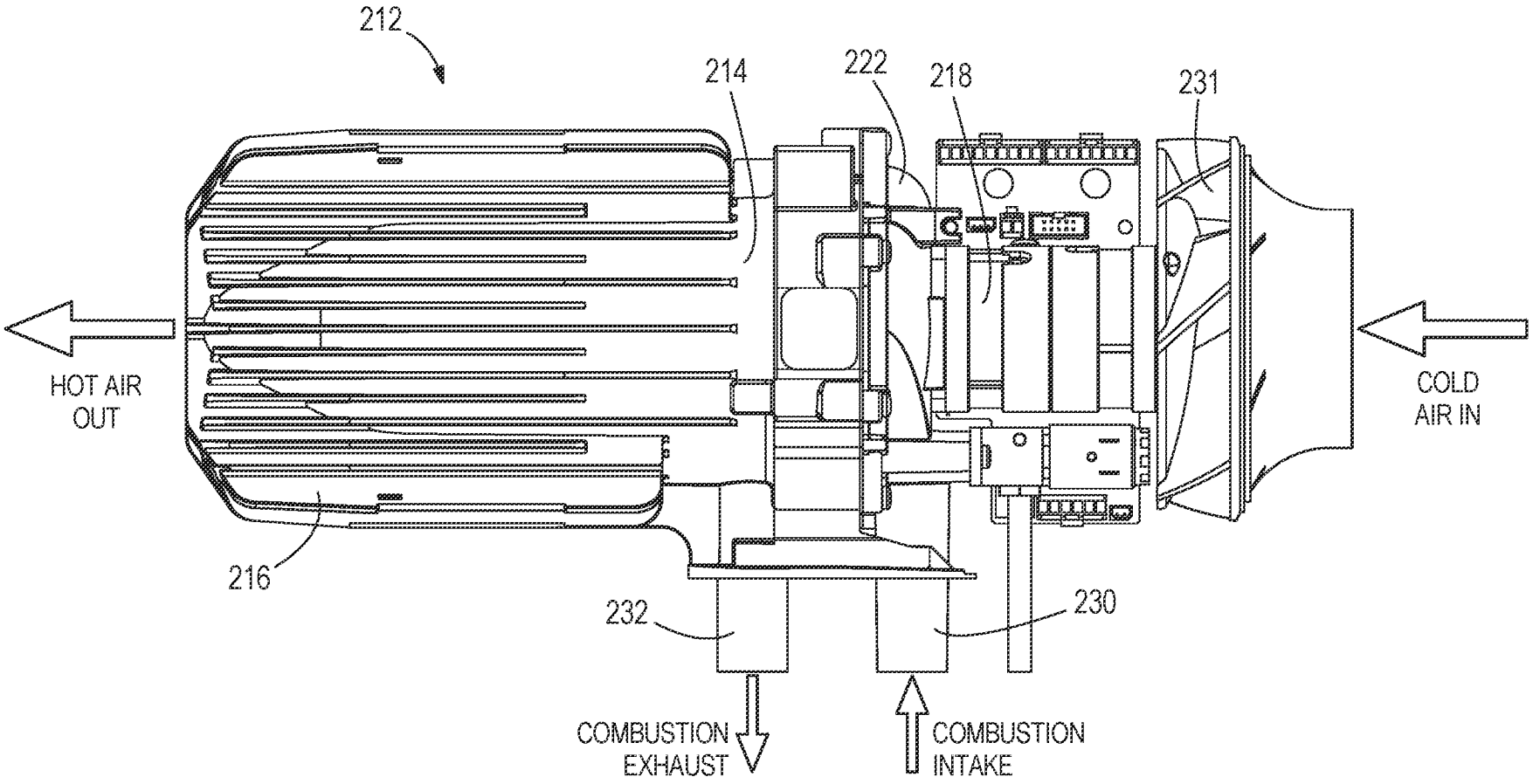
FIG. 10 is an exploded view of the example shown in FIG. 8, illustrating air flow through and across the heat exchanger.

FIGS. 8-10 depict an example wherein the gas burner system 12 is incorporated with a heat exchanger 212 having a cast aluminum body 214 with a plurality of heat radiating fins 216. The gas burner 10 extends into the body 214 and is coupled to the heat exchanger 212 so that the heat generated by the gas burner 10 heats the heat exchanger 212. In this example, the variable-speed forced-air device 40 is a fan that is powered by a motor 218. The motor 218 has an output shaft 220 that extends through a combustion chamber end cap 222 into engagement with the forced-air device 40. Operation of the motor 218 thus causes rotation of the fan (forced-air device 40) and forces air through the gas burner 10 as will be described further herein below. Note that the concepts of the present disclosure are not limited for use with a heat exchanger and could be employed in other devices containing the gas burner system 12.

Referring to FIG. 9, a plastic housing 224 houses the heat exchanger 212 and gas burner 10, as well as the forced-air device 40 and associated motor 218. The housing 224 has an upstream cool air inlet 226 that receives relatively cool air and downstream warm air outlet 228 that discharges relatively warm air. A second fan 231 is disposed in the housing 224 and configured to draw ambient air into the cool air inlet 226 and force it across the heat exchanger 212, and out of the downstream warm air outlet 228. As the air travels across the heat exchanger 212, as will be understood by those having ordinary skill in the art, the air exchanges heat with the heat exchanger and is warmed prior to discharge via the warm air outlet 228.

Referring to FIGS. 9 and 10, a combustion intake port 230 extends through the housing 224 and leads to the forced-air device 40. A combustion exhaust port 232 also extends through the housing 224 from the interior of the heat exchanger 212. The combustion intake and exhaust ports 230, 232 are configured so that air for combustion in the gas burner 10 is drawn by the variable speed forced-air device (here, a fan) 40 into the gas burner 10. Air having been warmed by the gas burner 10 is discharged to the interior of the heat exchanger 212 and then returned to the combustion exhaust port 232. As shown in FIG. 8, the combustion chamber end cap 222 encloses the variable-speed forced-air device 40 with respect to the heat exchanger 212 and thus separates the flow of combustion air with respect to the air being heated by the heat exchanger 212. The control valve 44 is mounted on the combustion chamber end cap 222.

Referring back to FIG. 5, as will be further described herein below with reference to FIGS. 11 and 12, the controller 50 is configured to operate the control valve 44 and forced-air device 40 to provide the air-gas mixture to the gas burner 10 in accordance with a selected power setting (e.g., Low, Medium, High). For each power setting, the controller 50 is configured to control the speed of the forced-air device 40 to vary the air-gas mixture and actively cause the actual flame strength to correspond to a "target flame strength set point" for that setting. The "target flame strength set point" is stored in the memory 56 of the controller 50 and is initially determined via a novel calibration method 100, an example of which is further described herein below with reference to FIG. 11.

Now referring to FIG. 11, at step 102, the controller 50 operates the gas burner system 12 to ignite the air-gas mixture and produce a flame 29, as described herein above. The controller 50 initially operates the gas burner system 12 in the Low power setting. The controller 50 automatically controls the speed of the forced-air device 40 to produce a flame 29 having an actual flame strength, as monitored by the ionization current of the electrode 30, which corresponds to a "startup flame strength set point". The startup flame strength set point is a value that is pre-selected for the particular power setting by the manufacturer of the gas burner system 12 and saved in the memory 56 when the product is manufactured. Thereafter, the controller 50 is programmed to follow a well-known proportional-integral-derivative (PID) algorithm to maintain the actual flame strength at or proximate to the startup flame strength set point. PID algorithms are "feedback" loops that takes measurements of the physical value that needs to be controlled (in this case the flame strength) and subtracts the desired value from it. The result is an "error" value (e). A linear combination of the "error", its integral and its derivative (u) is mapped onto a value (y) needed to set the physical controller (in this case speed of the combustion fan motor). When the speed of the combustion fan motor is changed then the flame strength is affected, and the new measurement is fed back into the PID. The result is that the combustion fan is constantly being adjusted to keep the flame strength at the desired value. With the specific motors and measurements used within the exemplary system, the PID can be reduced to a simple equation: Combustion_fan_speed=Initial_fan_speed−Ki×Integral-_of_the_error.

At step 104, the controller 50 determines whether a "target flame strength set point" for the Low power setting has been previously calibrated and saved in the memory 56. If it has, the controller 50 determines that the calibration method has already been completed for the Low power setting and proceeds to step 106, wherein the controller 50 regulates the speed of the forced air device 40 according to the saved target flame strength set point for the Low power setting. This is carried out via PID algorithm, as explained above. On the other hand, if the controller 50 determines at step 104 that target flame strength set point for the Low power setting has not been saved, the controller 50 proceeds with the calibration method at step 110.

At step 108, the controller 50 steadily decreases the speed of the forced-air device 40 while monitoring the ionization current via the electrode 30. This steadily reduces the air portion of the air-gas mixture and thus causes the actual flame strength to steadily increase until it reaches a maximum flame strength for that particular power setting of that particular gas burner system 12, which will vary from product to product based upon the varying manufacturing considerations described herein above. Once the actual flame strength reaches its maximum value or peak, continuing to reduce the air portion of the air-gas mixture will cause the flame strength to steadily decrease. In other words, steadily decreasing the speed of the forced-air device 40 causes the actual flame strength to change according to a bell-shaped curve C, wherein the actual flame strength first increases to its maximum strength or peak and then subsequently decreases away from the maximum value. This phenomenon is further described herein below with reference to FIG. 12. At step 110, the controller 50 is configured to determine whether the actual flame strength is still increasing. If it is still increasing, the controller 50 continues to decrease the speed of the forced-air device 40. If at step 110 the controller 50 determines that the actual flame strength has started decreasing, the controller 50 identifies that the actual flame strength has passed its maximum value or peak and the controller 50 notes the maximum flame strength reached during this step and proceeds to step 112. At step 112, the controller 50 determines whether the actual flame strength has been less than the maximum flame strength noted during step 110 for greater than or equal to 0.75 seconds. If not, the controller 50 determines that the maximum flame strength monitored during step 110 may not actually correspond to the actual maximum or peak flame strength for that setting, and so the controller 50 begins again at step 108. If the controller 50 determines that the actual flame strength has been less than the maximum flame strength for greater than or equal to 0.75 seconds, the controller 50 proceeds to step 114 and increases the speed of the forced air device 40 until the maximum flame strength monitored during step 112 is reached again. Once the maximum flame strength monitored during step 110 is reached again in step 114, the controller 50 increases a "peak reached count" saved in the memory 56 by one and proceeds to step 116.

At step 116, the controller 50 determines whether the maximum flame strength has been reached by a count of greater than three when increasing the speed of the forced air device 40 at step 114. This could occur when the controller 50 restarts the method more than three times according to one of the "fail-safes" explained herein below under steps 120 and 122. If so, the controller 50 determines there is a system error state, and at step 118 enacts a "safety lockout", which is a fault state wherein the controller 50 prevents operation of the gas burner system 12 and optionally indicates the error to the operator via the indicator device 62. This error state would then need to be rectified by a technician. If the count is not greater than three, the controller 50 continues to step 120.

At step 120, the controller 50 determines whether the maximum flame strength is within an expected range of 1.91 uA to 4.85 uA, which corresponds to a usual range within which the peak flame strength is expected to fall, as determined by the present inventors through trial and error with the configuration of the gas burner system 12 described herein above. If not, then the controller 50 assumes that the noted maximum flame strength does not correspond to the actual peak flame strength for that setting, and thus the controller 50 increases the count by one and begins the method again at step 108. If at step 120 the maximum flame strength falls within the expected range, the controller 50 continues to step 122, wherein the controller 50 determines whether the maximum flame strength occurring at step 114 is within five percent of the maximum flame strength occurring when decreasing the speed of the forced air device 40 at step 108. If not, the controller 50 assumes that the maximum flame strength does not correspond to the actual peak flame strength for that setting, and the controller 50 increases the count by one and begins the method again at step 108. If it does fall within five percent of the maximum flame strength found at step 108, the controller 50 assumes that the maximum flame strength represents the "actual peak flame strength" for that setting of the gas burner system 12 and the controller 50 proceeds to step 124.

At step 124, the controller 50 is configured to calculate a target flame strength set point for the Low power setting based upon the actual peak flame strength determined from steps 106-122. The calculation comprises multiplying the peak flame strength by a percentage stored in the memory 56. The percentage can vary and is selected based on trial and error by the manufacturer to correspond with the typical most efficient operating flame strength for such gas burner systems. In this example, the present inventors determined that appropriate percentages for the three power settings are 85% for the Low power setting, 55% for the Medium power setting, and 50% for the High power setting.

At step 126, the controller 50 is configured to determine whether the target flame strength set point calculated in step 124 is within a safety band comprising a range of values around a default set point, which has been predetermined through trial and error by the inventors to correspond to an expected peak flame strength set point, and stored in the memory 56. If it is not, the controller 50 determines there is a system error and at step 128 enacts a safety lockout, optionally indicating the error to the operator via the indicator device 62. If at step 126 the target flame strength set point is within the stored safety band, the controller 50 proceeds to step 130 and saves the target flame strength set point in the memory 56.

Once the target flame strength set point is stored in the memory 56, the controller 50 at step 132 again increases the speed of the forced air device 40 and at step 134 monitors the actual flame strength, via the ionization current of the electrode 30, to determine when the actual flame strength reaches the stored target flame strength set point. Thereafter, the controller 50 proceeds to step 136, wherein the controller 50 regulates the speed of the forced air device 40 according to the target flame strength set point for the Low power setting, via known PID algorithms, as described herein above.

The controller 50 at step 138 repeats steps 108-134 for each power setting. The controller 50 can be programmed to do this automatically or based upon an operator command via the operator input device 60.

In certain examples, the controller 50 can also be configured with a timeout process 139, whereby the controller 50 enacts a safety lockout if the calibration process does not conclude after expiration of a stored time period. More specifically at step 140, the controller 50 determines whether the stored time period expires from when the process was initiated. If not, the calibration method continues at step 142 wherein the controller 50 enacts a safety lockout, optionally indicating the error to the operator via the indicator device 62. If it does, the controller continues the calibration method, as shown at step 144.

Figure 11:
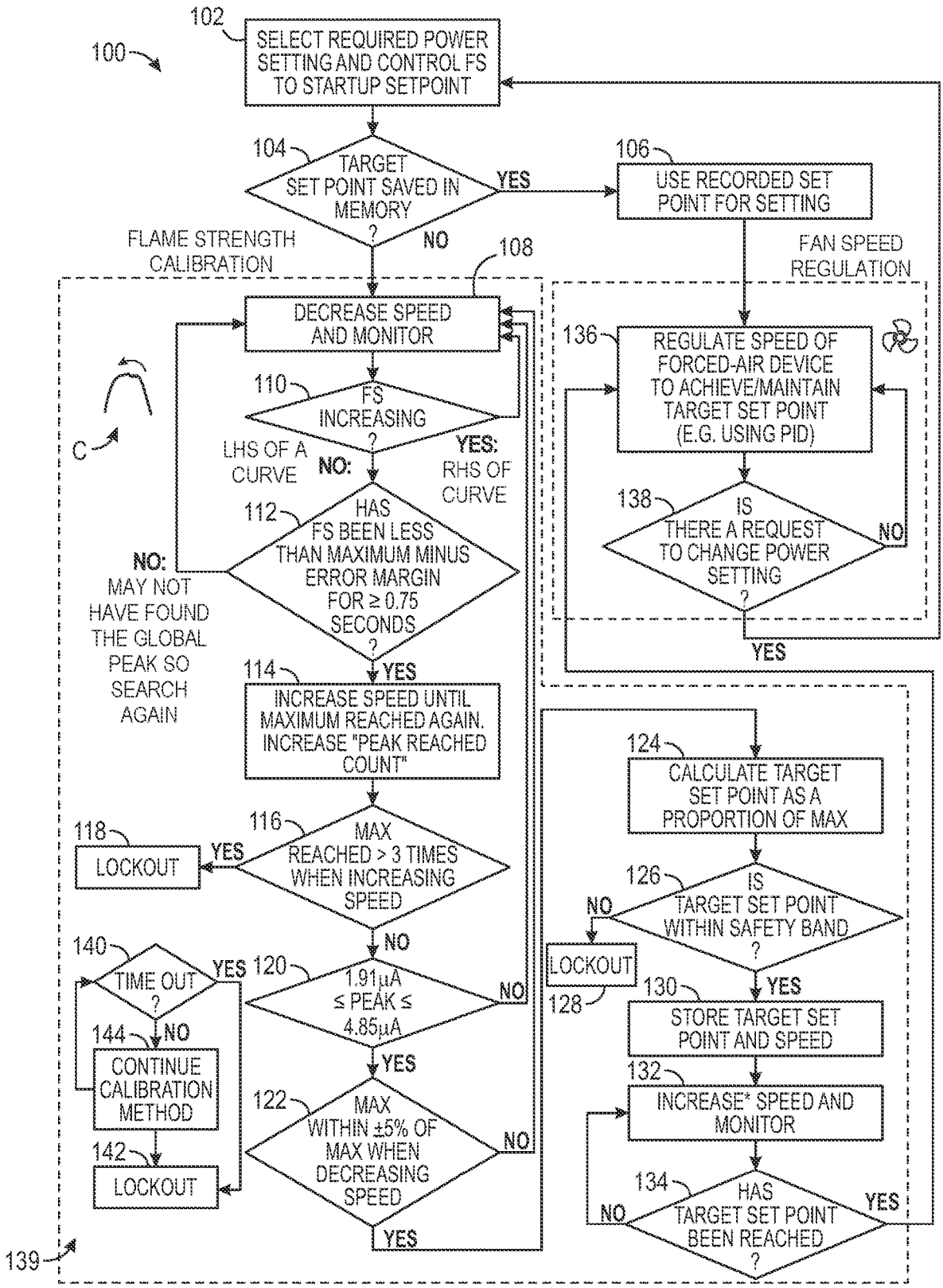
FIG. 11 is a flow chart for an exemplary calibration method according to the present disclosure.
Figure 12:
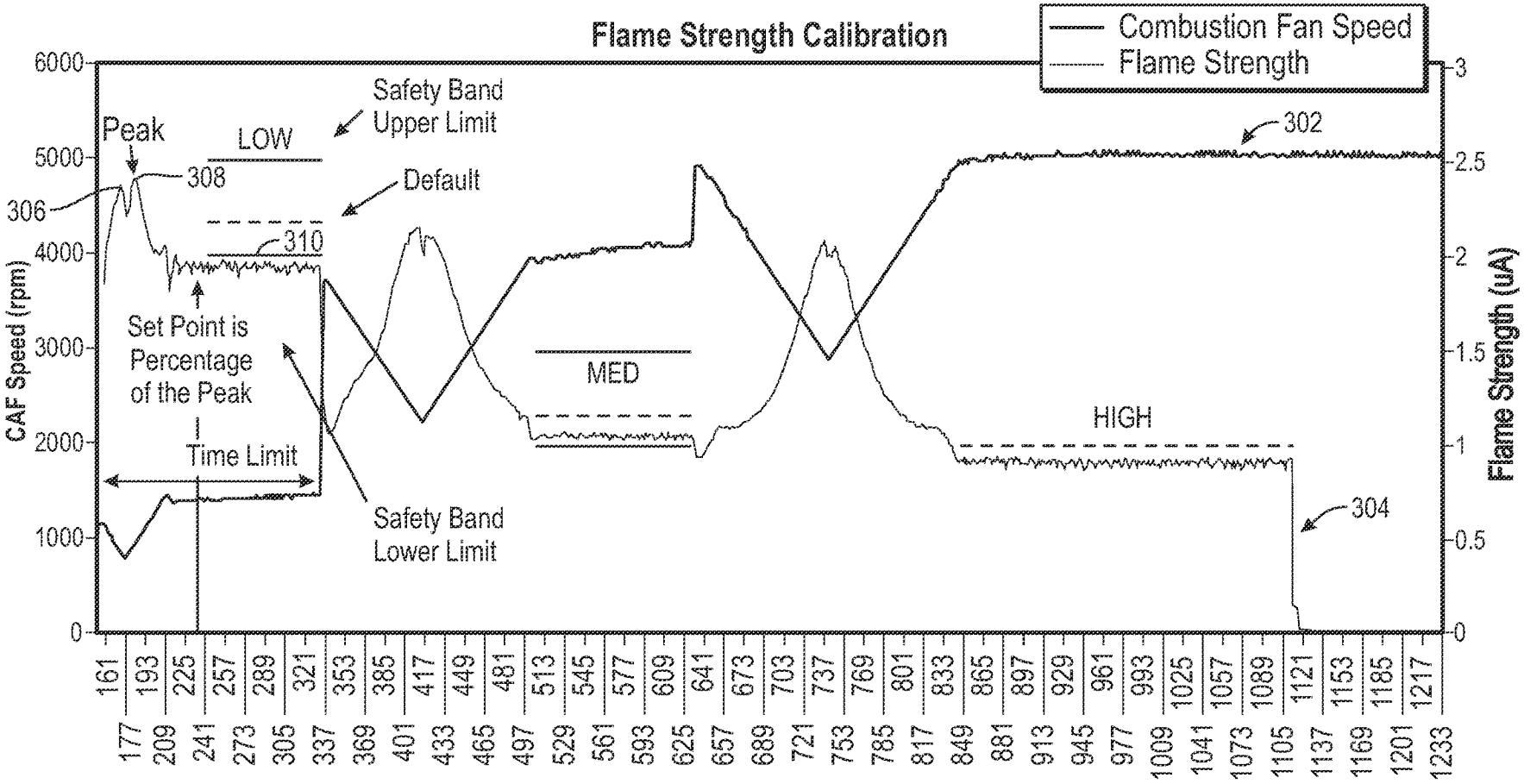
FIG. 12 is a graph illustrating combustion fan speed versus flame strength during the calibration method.

FIG. 12 graphically depicts one example of the flame strength calibration process shown in FIG. 11. Line 302 illustrates the change in speed of the forced-air device 40 over time and line 304 illustrates the corresponding change in flame strength (as measured via the electrode 30) over time. The graph depicts the trends in speed of the forced air device 40 and flame strength, wherein the speed of the forced-air device 40 is initially reduced, which correspondingly causes the flame strength to increase until it reaches a maximum value (see 306) and then begin to decrease. At this point, the controller 50 increases the speed of the forced air device 40, which causes the flame strength to increase again to a maximum value (see 308) and then begin to decrease again. Thereafter, assuming the lockout criteria at steps 116, 120 and 122 are met, the controller 50 calculates the target flame strength set point for the Low power setting as a percentage (e.g., 85%) and controls speed of the forced-air device 40 according to the target flame strength set point, via for example the above-noted PID algorithm of the graph (see 310). Thereafter the process repeats for the Medium and High power settings, as shown in the graph.

It will thus be seen that the present disclosure provides a novel gas burner system comprising a gas burner through which an air-gas mixture is conducted; a variable-speed forced-air device that forces air through the gas burner; a control valve that controls a supply of gas for mixture with the air to thereby form the air-gas mixture; an electrode configured to ignite the air-gas mixture and produce a flame, wherein the electrode is further configured to measure an actual flame strength of the flame; and a controller and an input device for inputting a calibration command to the controller. Upon receipt of the calibration command, the controller is configured to automatically calibrate and save the target flame strength set point, and thereafter automatically regulate a speed of the variable-speed forced-air device to cause the actual flame strength to achieve the target flame strength set point.

In certain examples, the controller is configured to calibrate the target flame strength set point by first determining a peak flame strength for the gas burner system and then calculating the target flame strength set point based on the peak flame strength. The controller is also configured to determine the peak flame strength by monitoring the actual flame strength while decreasing and then increasing the speed of the variable-speed forced-air device, as explained herein above. The peak flame strength is a maximum flame strength occurring when the variable-speed forced-air device is decreased and then increased, and the controller is configured to calculate the target flame strength set point by calculating a preset percentage of the peak flame strength.

The control valve comprises at least two solenoids having a closed position preventing flow of gas there through and a wide-open position allowing flow of gas there through. The control valve thus facilitates four discrete power settings, including off, low setting, medium setting, and high setting. In certain examples, the controller is configured to automatically calibrate and save the target flame strength set point for the low setting and then further to automatically calibrate and save additional target flame strength set points for the medium setting and high setting, respectively.

An indicator device can be provided, as explained herein above, and configured to indicate to an operator when the controller has calibrated and saved the target flame strength set point. The controller is configured to stop automatically calibrating the target flame strength set point upon occurrence of a fault state. The fault state can for example include expiration of a time from initiation of calibration by the controller. The fault state can also or alternately include a determination by the controller that the peak flame strength is outside of a stored range of flame strengths. The fault state can also or alternately include a determination by the controller that the target flame strength set point is outside of a stored range of target flame strength set points.

The present disclosure further provides novel methods of operating the gas burner system, including operating the controller to automatically calibrate and save a target flame strength set point for the controller, and to thereafter monitor an actual flame strength via the electrode and regulate a speed of the variable-speed forced air device to achieve the target flame strength set point. The method can include operating the controller to calibrate the target flame strength set point by first determining a peak flame strength for the gas burner system and then calculating the target flame strength set point based on the peak flame strength. The method can include operating the controller to determine the peak flame strength by monitoring the actual flame strength while decreasing and then increasing the speed of the variable-speed forced-air device. The method can include operating the controller to calculate the target flame strength set point by calculating a preset percentage of the peak flame strength. The method can further include operating the controller to automatically calibrate and save the target flame strength set point for the low setting and then further to automatically calibrate and save additional target flame strength set points for the medium setting and high setting, respectively. The method can further include indicating to an operator when the controller calibrates and saves the target flame strength set point. The method can further include operating the controller to stop automatically calibrating the target flame strength set point upon occurrence of a fault state.

In the present description, certain terms have been used for brevity, clearness and understanding. No unnecessary limitations are to be implied therefrom beyond the requirement of the prior art because such terms are used for descriptive purposes only and are intended to be broadly construed. The different systems, methods and apparatuses described herein may be used alone or in combination with other systems, methods, and apparatuses. Various equivalents, alternatives and modifications are possible within the scope of the appended claims.

What is claimed is:

1. A gas burner system comprising:

a gas burner through which an air-gas mixture is conducted;

a variable-speed forced-air device that forces air through the gas burner;

a control valve that controls a supply of gas for mixture with the air to thereby form the air-gas mixture;

an electrode configured to ignite the air-gas mixture and produce a flame, wherein the electrode is further configured to measure an actual flame strength of the flame; and a controller and an input device for inputting a calibration command to the controller, wherein upon receipt of the calibration command, the controller is configured to automatically calibrate and save a target flame strength setpoint, and thereafter automatically regulate a speed of the variable-speed forced-air device to cause the actual flame strength to achieve the target flame strength setpoint;

wherein the controller is configured to calibrate the target flame strength set point by first determining a peak flame strength for the gas burner system and then calculating the target flame strength set point based on the peak flame strength.

2. The gas burner system according to claim 1, wherein the controller is configured to determine the peak flame strength by monitoring the actual flame strength while decreasing and then increasing the speed of the variable-speed forced-air device.

3. The gas burner system according to claim 2, wherein the peak flame strength is a maximum flame strength occurring when the variable-speed forced-air device is decreased and then increased.

4. The gas burner system according to claim 3, wherein the controller is configured to calculate the target flame strength set point by calculating a preset percentage of the peak flame strength.

5. The gas burner system according to claim 1, wherein the control valve comprises at least two solenoids having a closed position preventing flow of gas there through and a wide-open position allowing flow of gas there through.

6. The gas burner system according to claim 5, wherein the control valve facilitates four discrete power settings, including off, low setting, medium setting, and high setting.

7. The gas burner system according to claim 6, wherein the controller is configured to automatically calibrate and save the target flame strength set point for the low setting and then further to automatically calibrate and save additional target flame strength set points for the medium setting and high setting, respectively.

8. The gas burner system according to claim 1, further comprising an indicator device that indicates to an operator when the controller calibrates and saves the target flame strength set point.

9. The gas burner system according to claim 1, wherein the controller is configured to stop automatically calibrating the target flame strength set point upon occurrence of a fault state.

10. The gas burner system according to claim 9, wherein the fault state comprises expiration of a time from initiation of calibration by the controller.

11. The gas burner system according to claim 9, wherein the fault state comprises a determination by the controller that the peak flame strength is outside of a stored range of flame strengths.

12. The gas burner system according to claim 9, wherein the fault state comprises a determination by the controller that the target flame strength set point is outside of a stored range of target flame strength set points.

13. A method of operating a gas burner system, the method comprising:

providing a gas burner;

supplying a gas to the gas burner;

operating a variable-speed forced-air device to force air into the gas burner and mix with the gas to form an air-gas mixture;

operating an electrode to ignite the air-gas mixture and produce a flame; and operating a controller to automatically calibrate and save a target flame strength set point for the controller, and to thereafter monitor an actual flame strength via the electrode and regulate a speed of the variable-speed forced air device to achieve the target flame strength setpoint; and operating the controller to calibrate the target flame strength set point by first determining a peak flame strength for the gas burner system and then calculating the target flame strength set point based on the peak flame strength.

14. The method according to claim 13, further comprising operating the controller to determine the peak flame strength by monitoring the actual flame strength while decreasing and then increasing the speed of the variable-speed forced-air device.

15. The method according to claim 14, further comprising operating the controller to calculate the target flame strength set point by calculating a preset percentage of the peak flame strength.

16. The method according to claim 15, further comprising operating the controller to automatically calibrate and save the target flame strength set point for a low setting and then further to automatically calibrate and save additional target flame strength set points for a medium setting and a high setting, respectively.

17. The method according to claim 16, further comprising indicating to an operator when the controller calibrates and saves the target flame strength set point.

18. The method according to claim 16, further comprising operating the controller to stop automatically calibrating the target flame strength set point upon occurrence of a fault state.

* * * * *